US007021679B2

(12) United States Patent
Magnusson

(10) Patent No.: US 7,021,679 B2
(45) Date of Patent: Apr. 4, 2006

(54) LOCKING DEVICE

(75) Inventor: Claes Magnusson, Wimbledon (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 11/030,456

(22) Filed: Jan. 6, 2005

(65) Prior Publication Data

US 2005/0151378 A1 Jul. 14, 2005

Related U.S. Application Data

(63) Continuation of application No. 10/393,023, filed on Mar. 21, 2003, now Pat. No. 6,854,774.

(51) Int. Cl.
*E05C 5/00* (2006.01)

(52) U.S. Cl. ..... 292/66; 292/247

(58) Field of Classification Search ..... 292/165, 292/350, 247, 57, 58, 61, 63, 66, 71
See application file for complete search history.

(56) References Cited

U.S. PATENT DOCUMENTS 1,315,266 A 9/1919 Weiland
1,575,114 A * 3/1926 Gilmore ..... 292/60
1,822,110 A 9/1931 Raymond
2,019,692 A 11/1935 Mueller
2,128,014 A 8/1938 Platin
2,485,054 A 10/1949 Lickteig
2,762,641 A 9/1956 Gilmour
RE24,426 E 2/1958 Quinn
2,924,478 A 2/1960 Wartian
2,926,037 A 2/1960 Granzow
3,302,964 A 2/1967 Barry
4,877,278 A 10/1989 Valley
4,978,152 A 12/1990 Bisbing

FOREIGN PATENT DOCUMENTS

JP 6-158928 6/1994

* cited by examiner

*Primary Examiner*—Gary Estremsky
(74) *Attorney, Agent, or Firm*—Paul & Paul

(57) ABSTRACT

A locking device includes a handle member, a rotatable member connected to the handle member, and a bolt member connected to the rotatable member so as to follow rotational movements of the handle between a locking position and an unlocking position of the locking device. The bolt member includes a latch bolt spring-loaded towards an extended locking position and operative to yield towards a less extended position when encountering a stationary part of a coaming when positioned in its locking position.

3 Claims, 5 Drawing Sheets

LOCKING DEVICE

CROSS-REFERENCE TO RELATED APPLICATION

This is a continuation of U.S. patent application Ser. No. 10/393,023, filed Mar. 21, 2003, now U.S. Pat. No. 6,854,774.

FIELD OF THE INVENTION

The present invention concerns a locking device of the kind including a handle member, a rotatable member connected to the handle member, and a bolt member connected to the rotatable member so as to follow rotational movements of the handle between an open or unlocked position and a locked position.

BACKGROUND OF THE INVENTION

A locking device of this kind is often mounted in a hatch, a door or the like in order to enable locking of the hatch etc., and it is typically operated by turning the handle through 90° between the open and the locked position. Hereby, a free end of the bolt member is moved typically from a position underneath the hatch etc. to a position where it extends outside the limits of the hatch to engage a coaming of the hatch. In an open position of the hatch, it may inadvertently occur that the locking device is in a position where the bolt member projects more or less beyond the limits of the hatch. In case the hatch is slammed in such bolt position, there is an obvious risk that the bolt member and/or the coaming may be damaged. The present invention has as its object to provide a locking device of the kind initially stated that does suffer from this risk.

SUMMARY OF THE INVENTION

According to the present invention there is provided a locking device including a handle member, a rotatable member connected to the handle member, and a bolt member connected to the rotatable member so as to follow rotational movements of the handle between a locking position and an unlocking position of the locking device, wherein the bolt member includes a latch bolt spring-loaded towards an extended locking position and operative to yield towards a-less extended position when encountering a stationary part of a coaming.

BRIEF DESCRIPTION OF THE DRAWINGS

Further scope of applicability of the present invention will become apparent from the detailed description given hereafter. However, it should be understood that the detailed description and specific example, while indicating a preferred embodiment of the invention, are given by way of illustration only, since various changes and modifications within the spirit and scope of the invention will become apparent to those skilled in the art from this detailed description, reference being made to the accompanying drawings, wherein.

DETAILED DESCRIPTION OF THE INVENTION

Figure 1:
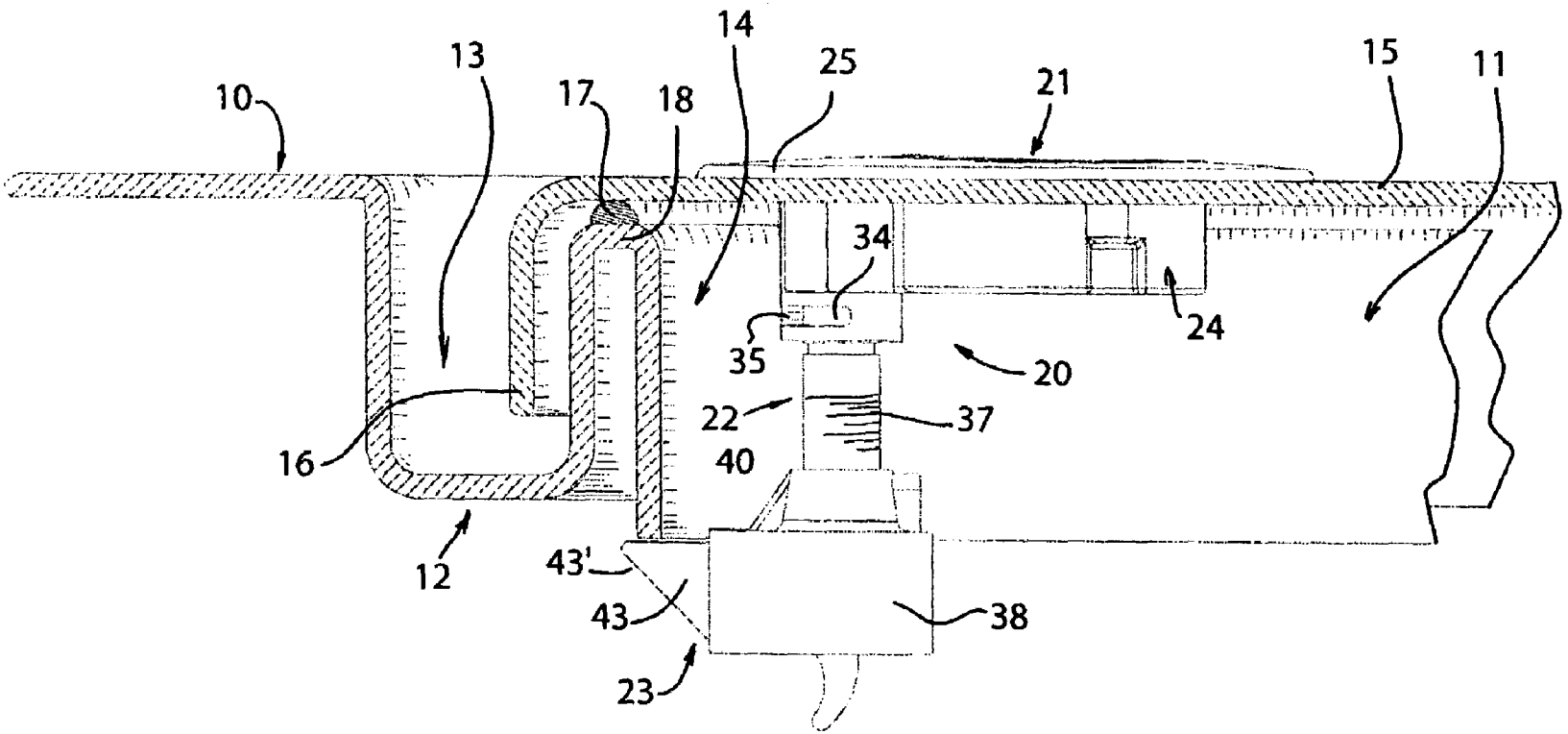
FIG. 1 is a section through a portion of a deck provided with a hatchway closed by a hatch cover provided with a locking device according to the present invention shown in its locking position.

In the Figures, 10 designates a normally horizontal surface, such as the deck of, e.g., a yacht, having therein a typically rectangular hatchway 11, of which only a minor portion is shown. The hatchway is defined by a coaming in the shape of a substantially S-shaped rim 12 integral with the deck and including a substantially U-shaped draining channel 13 and a downwardly turned edge portion 14. A hatch cover 15 having a downwardly turned exterior edge 16 is dimensioned such that the edge 16 is located within the draining channel 13 in the closed position of the hatch shown. A resilient sealing element 17 is attached to the crest portion 18 of the rim 12 joining the draining channel and the edge portion 14 in order to seal the space underneath the hatch cover 15 from the exterior environment.

A locking device 20 according to the present invention is mounted in the hatch cover 15 close to one side thereof. Non-shown hinges are provided along an opposite side of the hatch cover.

The locking device 20 includes a handle member 21, a rotatable member 22 connected to the handle member, and a bolt member 23 connected to the rotatable member.

More in detail, a housing 24 having a flange 25 is mounted in an aperture 26 in the hatch cover 15 with the flange resting on the upper surface of the hatch cover. The handle member 21 is shown to be a ring-like structure accommodated within a housing recess 27 having a bottom wall 28. In the position shown in FIGS. 1 and 2, the handle member is substantially flush with the upper surface of the flange 25. A protrusion 29 at the exterior circumference of the handle member has a hole 30 for a pivot pin 31 pivotably connecting the handle member to the upper end of a spindle 32 vertically extending through the bottom wall 28. By means of the hole 30 and the pivot pin 31 the handle member 21 may be swung from the position shown in FIGS. 1 and 2 to the position shown in FIG. 3.

The shaft is guided for rotation by a sleeve-like protrusion 33 integral with the bottom wall 28. A slot 34 is provided in the wall of the protrusion 33 to extend over an angle of preferably 90°. A pin 35 is received in a cross-bore 36 in the spindle 32 thereby limiting rotational movement of the spindle and the handle member by abutment against the ends of the slot 34.

Figure 3:
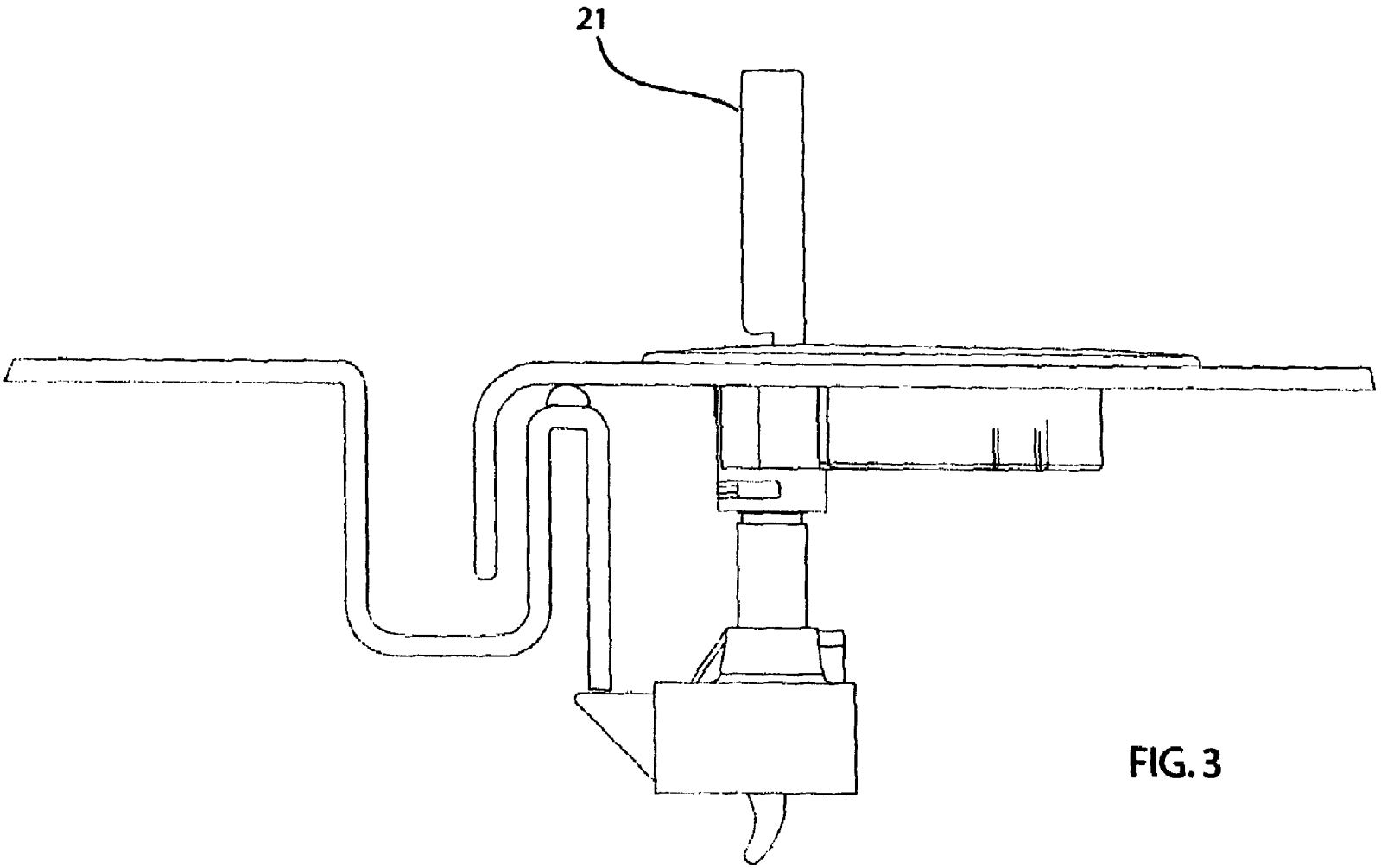
FIG. 3 is a view corresponding to FIG. 1 but showing the lock in a preparatory step for opening.
Figure 4:
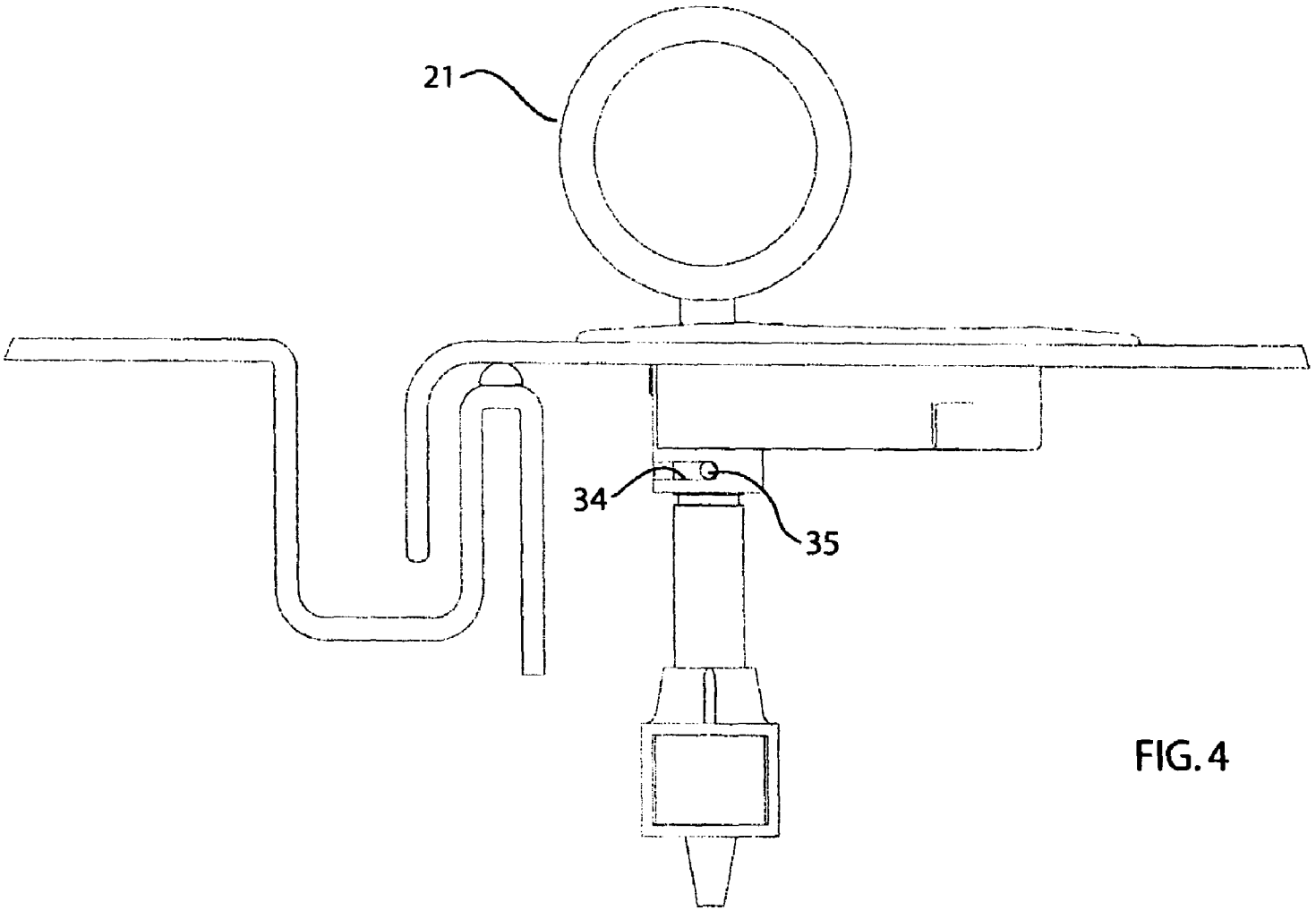
FIG. 4 is a view corresponding to FIG. 3 but showing the locking device rotated into its open position.

In the position of the handle member shown in FIG. 3, it may be rotated through 90° to the position shown in FIG. 4.

The lower end of the spindle 32 is provided with threads 37, and a latch bolt housing 38 is threaded thereon by means of internal threads 39 provided in an upper portion 40 of the housing. A peripheral, longitudinally extending groove 41 is provided in the spindle 32, and a stop screw 42 is threaded through the upper portion 40 to arrest rotation of the latch bolt housing relative to the spindle in a chosen rotational position of the former.

Figure 2:
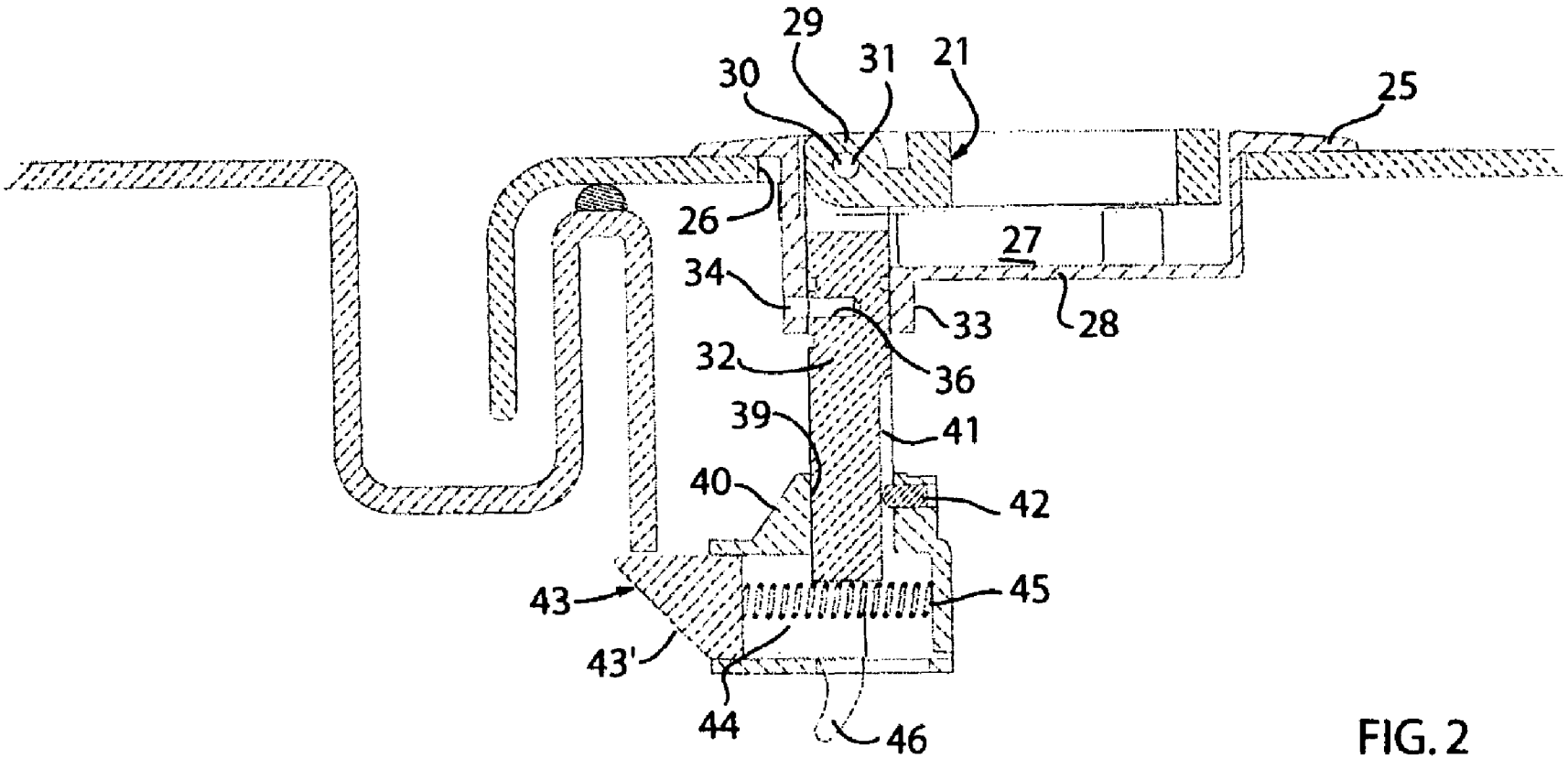
FIG. 2 is a view similar to FIG. 1 showing also the locking device sectioned.

A latch bolt 43 is received within the latch bolt housing to be slidingly guided between a fully extended position shown in FIGS. 1, 2 and 3, and a fully retracted position not particularly shown. A spring 44, having one end supported against a rear wall 45 of the latch bolt housing and an opposite end supported against the latch bolt, urges the latch bolt towards its extended position. A handle 46 connected to the latch bolt enables manual operation thereof.

FIG. 1 shows the locking device in its locking position with the latch bolt extended to be located underneath the lower edge 14' of the edge portion 14. To open the locking device, the handle portion is swung open as shown in FIG. 3, and the handle is rotated (counterclockwise as seen from above) through 90° to the position shown in FIG. 4, thereby moving the latch bolt free from its engagement under the edge 14'. The hatch cover is now free to be opened.

Figure 5:
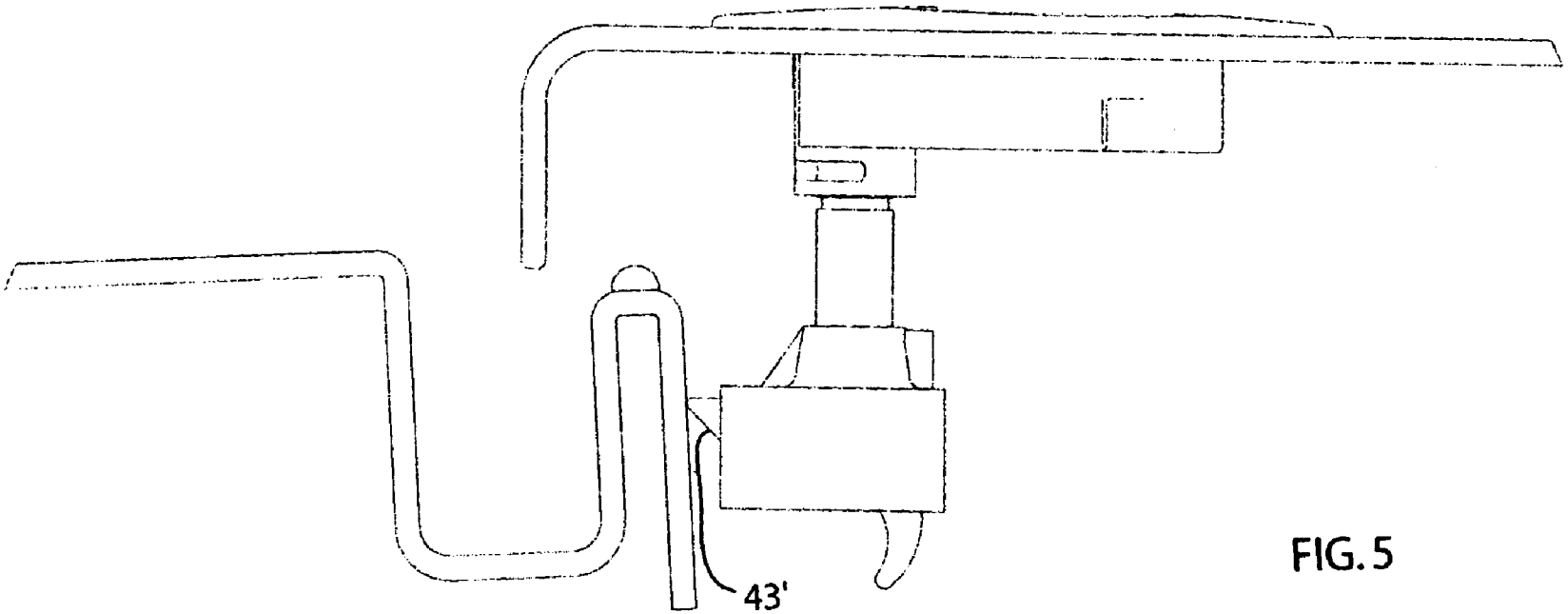
FIG. 5 is a view similar to FIG. 1, but showing the locking device rotated back to its locking position and the hatch approaching its closed position.

Of course, the hatch cover may be closed with the locking device in this last position, and then to turn the handle member to the position of FIG. 1, but, as a result of the present invention, it is also possible, and preferable, to rotate the handle member after opening of the hatch cover to the position according to FIG. 3 and also to swing the handle member down to its position according to FIG. 1. In this position, the hatch cover may be slammed without any risk of damaging any part of the locking device, since the beveled surface 43' of the latch bolt 43 will encounter the upper part of the edge portion 14 of the rim 12 at its crest portion 18 and cause displacement of the latch bolt towards its retracted position, as shown in FIG. 5. As soon as the latch bolt comes free from the edge portion 14, it will snap into the locked position of the locking device shown in FIG. 1.

By proper adjustment of the vertical position of the latch bolt housing 38 relative to the spindle 32, the vertical position of the latch bolt 43, and thereby the resilient compression of the sealing element 17 may be adjusted.

In case a person should be trapped within the hatch, the handle 46 enables manual opening of the locking device and escape from the hatch.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A locking device including:

a handle member, a rotatable spindle connected to the handle member, and a bolt member connected to the rotatable spindle, the bolt member rotating together with the handle member as a unit between a locking position and an unlocking position of the locking device, the position of the bolt member on the spindle being adjustable along the spindle;

wherein the bolt member includes a latch bolt spring-loaded towards an extended locking position and operative to yield towards a less extended position when encountering a stationary part of a coaming when positioned in its locking position, and the rotatable spindle carrying the handle member and a latch bolt housing, the latch bolt being slidably received in said latch bolt housing.

2. A locking device according to claim 1, wherein the rotatable spindle pivotably carries the handle member at one end and having an opposite end, the latch bolt housing being mounted onto said opposite end.

3. A locking device according to claim 2, wherein latch bolt housing is fixed in one of a plurality of rotational positions relative to the spindle.

* * * * *